US009653786B2

(12) United States Patent
Kenoun

(10) Patent No.: US 9,653,786 B2
(45) Date of Patent: May 16, 2017

(54) WEARABLE ANTENNA SYSTEM

(71) Applicant: Intel Corporation, Santa Clara, CA (US)

(72) Inventor: Robert Kenoun, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 38 days.

(21) Appl. No.: 14/752,897

(22) Filed: Jun. 27, 2015

(65) Prior Publication Data

US 2016/0380342 A1 Dec. 29, 2016

(51) Int. Cl.
*H01Q 1/27* (2006.01)
*H01Q 21/00* (2006.01)

(52) U.S. Cl.
CPC ..... *H01Q 1/273* (2013.01); *H01Q 21/0006* (2013.01); *H01Q 21/0087* (2013.01)

(58) Field of Classification Search
CPC ..... H01Q 1/273; H01Q 1/243; H01Q 1/38; H01Q 21/0006; H01Q 21/0087; H04B 1/385; H04M 3/00
USPC ..... 343/702, 718; 455/419
See application file for complete search history.

(56) References Cited

U.S. PATENT DOCUMENTS 5,781,155 A * 7/1998 Woo ..... G01S 19/34 342/352
6,278,873 B1 8/2001 Itakura et al.
8,833,665 B2 * 9/2014 Grange ..... G01S 7/03 235/487
9,141,089 B1 * 9/2015 Liou ..... G04R 60/14
9,450,298 B2 * 9/2016 Lee ..... H01Q 1/38
2007/0075913 A1 * 4/2007 Moriya ..... H01Q 7/06 343/895
2007/0207793 A1 * 9/2007 Myer ..... H04B 1/385 455/419
2012/0056792 A1 3/2012 Han
2013/0016016 A1 1/2013 Lin et al.
2014/0180365 A1 6/2014 Perryman et al.
2015/0091765 A1 * 4/2015 Frank ..... H01Q 1/273 343/718
2015/0255855 A1 * 9/2015 Tsai ..... H01Q 1/273 343/702
2016/0099497 A1 * 4/2016 Lee ..... H01Q 1/38 343/702

FOREIGN PATENT DOCUMENTS

EP 2178158 A1 4/2010

OTHER PUBLICATIONS

International Search Report and Written Opinion for PCT/US2016/034854 dated Aug. 24, 2016, 13 pages.

* cited by examiner

*Primary Examiner* — Lam T Mai
(74) *Attorney, Agent, or Firm* — Grossman, Tucker, Perreault & Pfleger, PLLC

(57) ABSTRACT

Smaller footprint electronic devices may be contained in a wearable housing, for example in a housing forming a portion of a watch that is worn on a user's wrist. Incorporating antennas into such small footprint devices often precludes the use of anything other than short range communications with another device. Incorporating an antenna into a watch band or bracelet provides a possible avenue to improving the long range communication capabilities and consequent utility of such smaller footprint electrical devices.

20 Claims, 4 Drawing Sheets

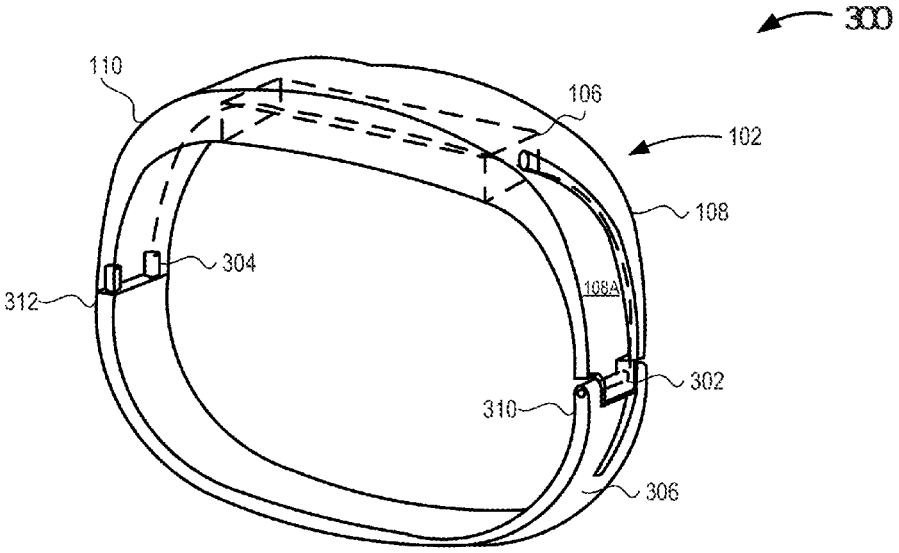
FIG. 3A
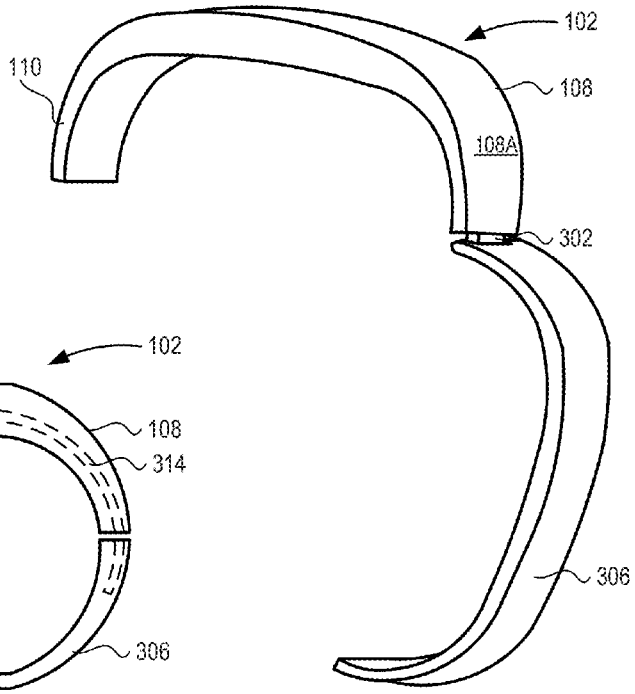
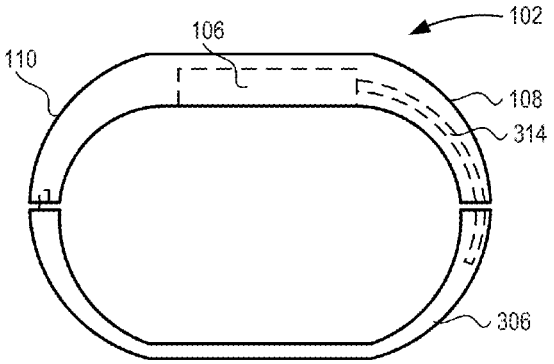
FIG. 3C
FIG. 3B

WEARABLE ANTENNA SYSTEM

TECHNICAL FIELD

The present disclosure relates to antenna systems.

BACKGROUND

The ever decreasing size of electronics, particularly computing devices, has opened a new spectrum of wearable devices such as Google Glass® (GOOGLE, INC., Mountain View, Calif.), FitBit® (FITBIT Inc., San Francisco, Calif.), and the Apple Watch® (APPLE, INC., Cupertino, Calif.). Many of these wearable computing devices include transceivers with limited range due, at least in part, to the inherently limited real estate in smaller wearable devices. For example, the Apple Watch is unable to independently place cellular telephone calls and must be paired to an iPhone® in order to place or receive cellular telephone calls.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

FIG. 3A is a perspective view depicting an example wearable electronic device and antenna system in the form of a bracelet in a closed or latched position, in accordance with at least one embodiment of the present disclosure;

FIG. 3B is a perspective view depicting an example wearable electronic device and antenna system in the form of a bracelet in an open or unlatched position, in accordance with at least one embodiment of the present disclosure;

FIG. 3C is an elevation view depicting an example wearable electronic device and antenna system in the form of a bracelet in a closed or latched position, in accordance with at least one embodiment of the present disclosure;

Figure 1:
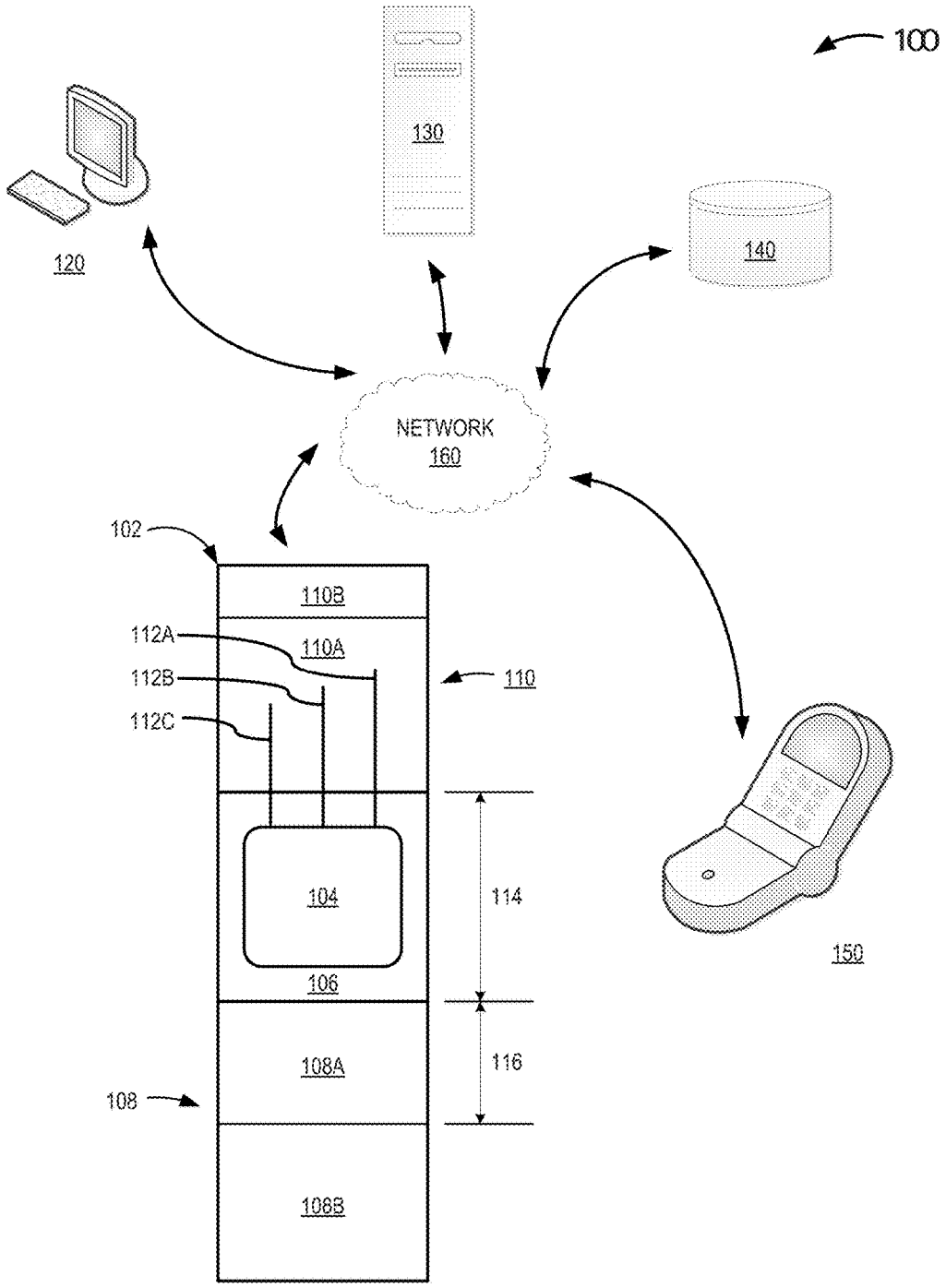
FIG. 1 is a block diagram depicting an example system including a wearable antenna system communicably coupled to a wearable electronic device, in accordance with at least one embodiment of the present disclosure.

Although the following Detailed Description will proceed with reference being made to illustrative embodiments, many alternatives, modifications and variations thereof will be apparent to those skilled in the art.

DETAILED DESCRIPTION

When fashion and communication systems collide in the world of wearable computing or electronic devices, creative solutions are required to provide an optimal environment that maximizes electronic system performance while maintaining desired aesthetic impact. Beneficially, in the fashion world few limitations exist regarding the usage of materials and form factors. Such inherent flexibility frees the fashion designer to craft wearable items that include metallic structures integrated in an appealing and attractive way to consumers. However, to the wearable electronics designer, such metallic structures may cause serious degradation to antenna performance if antennas are placed or positioned either in close proximity of, or within, such metallic structures. In fact, metallic structures may cause sufficient impairment to antenna performance that the antenna is effectively rendered inoperable. Thus, an electronic designer often attempts to provide the widest possible separation between antennas and metal structures, particularly in the tight confines found within wearable devices which are often a combination of electronic device and fashion statement. While electronic designers seek to improve antenna performance by changing the housing material about the electronic device to a non-conductive material, such a substitution may detrimentally compromise the esthetic value of the device.

Using an 800 MHz cellular band antenna as an illustrative example, such an antenna is relatively large and requires a proportionately larger footprint if placed, in its entirety, within an electronic device housing. In addition, such an antenna may require a significantly larger chassis or ground plane (herein referred to as a "counterpoise") to operate at an acceptable level of efficiency. In some instances, a portion of the wearable device (e.g., a portion of a bracelet or wrist band) may be formed from a conductive material to provide a counterpoise to an, otherwise, small electronic device housing. Such a counterpoise may be positioned opposite to one or more antennas used by the electronic device for wireless communications.

A wearable electronic device may include an electronic circuit board disposed in a housing. Electronic circuit board communicably couples to a number of antennas extending from the exterior surface of the housing. The wearable electronic device may further include a structure adapted to be worn on a limb, the structure including a first member physically and electrically conductively coupled to the housing, and a second member physically coupled to the housing, where the second member incorporates at least a portion of at least some of the antennas extending from the housing.

A method of combining a number of antennas with a wearable electronic device may include electrically conductively coupling each of the antennas to an electronic circuit board disposed in the housing. The method may further include extending number of antennas from an exterior surface of the housing. The method may additionally include physically and electrically conductively coupling a first end of a first member to a first location of the housing and physically coupling a first end of a second member of the structure to a second location of the housing, the second location of the housing separated by a first distance from the first location of the housing. The method may further include incorporating at least some of the number of antennas projecting from the exterior of the housing into the second member.

An antenna system may include a housing defining an interior space and an electronic circuit board disposed either wholly or partially within the interior space. The electronic device may include a number of conductively coupled antennas extending from an exterior of the housing. The antenna system may also include a flexible member having a first end and a second end, the flexible member including a number of conductive segments and a number of electrically non-conductive segments, the first end including an electrically non-conductive segment physically coupled to a first external attachment point on the housing and the second end including an electrically conductive segment physically and electrically conductively coupled to a second external attachment point on the housing, where each of the number of antennas extends a respective distance from the exterior of the housing and into the electrically non-conductive material at the first end of the flexible member.

A wearable electronic system may include means for electrically conductively coupling number of antennas to an electronic circuit board disposed in a housing and means for extending number of antennas from an exterior surface of the housing. The wearable antenna system may further include means for physically and electrically and conductively coupling a first end of a first member to a first location of the housing. The wearable antenna system may also include means for physically coupling a first end of a second member of the structure to a second location of the housing, the second location of the housing separated by a first distance from the first location of the housing and means for incorporating into the second member a portion of antennas extending from the exterior surface of the housing.

FIG. 1 illustrates a network system 100 in which an example wearable electronic device 102 that includes a first member 108 physically and electrically conductively coupled to a housing 106 having at least one electronic device 104 communicably coupled to a number of antennas 112A-112*n* (collectively, antennas 112) integrated into a second member 110 physically coupled to the housing 106 is able to wirelessly communicate with one or more networked devices, in accordance with at least one embodiment of the present disclosure. The wearable electronic device 102 may unidirectionally or bidirectionally communicate with one or more computers 120, one or more servers 130, one or more remote data storage centers 140, one or more portable, wearable, cellular, smartphone, or handheld electronic devices 150, or combinations thereof via one or more networks 160. Such communicable coupling may facilitate the transfer of data including, but not limited to, audio and video data and text and IP data from the wearable electronic device 100 to one or more portable electronic devices such as one or more cellular telephones or smartphones 150. Such communicable coupling may also facilitate the reception of data, such as Webpages, by the wearable electronic device 102.

The electronic device 104 may include any current or future developed electronic device including any number or combination of the following: one or more receivers, one or more transceivers, one or more controllers, one or more processors, one or more microprocessors, one or more user input devices, one or more output devices, one or more sensors, and similar. In some instances, the electronic device 106 may include one or more single- or multi-core processors, single- or multi-core microprocessors, one or more systems on a chip (SoCs), one or more reduced instruction set computers (RISCs), one or more application specific integrated circuits (ASICs), one or more digital signal processors (DSPs), or combinations thereof. In some implementations, the electronic device 106 may include one or more circuits capable of executing machine-readable instructions that, upon execution by the circuit, transform the circuit into one or more specialized or particular circuits. Such machine-readable instructions may be stored in whole or in part in a local storage device (e.g., a storage device local to the wearable electronic device 102) communicably coupled to the circuit. Such machine-readable instructions may be stored in whole or in part on one or more servers 130 or one or more data storage centers 140 that are accessed via the network 160.

The electronic device 104 may be disposed in whole or in part within a space, void, or cavity formed at least partially by the housing 106. The housing 106 may include, in whole or in part, a chassis or similar structure formed using an electrically conductive material, such as one or more electrically conductive metals or electrically conductive metal containing alloys. In some instances, an electrically conductive housing 106 may provide at least a portion of the ground plane for some or all of the number of antennas 112. Given the relatively small footprint of the wearable electronic device 102, such a ground plane may be inadequate and may compromise the performance of all or, at least, some of the antennas 112. In some implementations, at least a portion of the housing 106 may be formed from a material that is transparent or semi-transparent to at least electromagnetic radiation in the radio frequency spectrum (e.g., from about 3 kHz to about 300 GHz).

The first member 108 may include any device, system, or combination of systems and devices suitable for attaching, affixing, or otherwise permanently or detachably coupling the wearable electronic device 102 to a user or to an article worn by a user. In one example, the first member 108 may include a flexible member, such as a portion of a watch band or bracelet, adapted for wear about a user's arm. In another example, the first member 108 may include a rigid or semi-rigid member, such as a portion of a bracelet or similar device adapted for wear about a user's arm.

In some instances, the first member 108 may be physically and electrically conductively coupled to housing 106. For example, the first member 108 may be pivotably coupled to the housing 106 using a metallic or similar electrically conductive member to permanently or detachably attach the first member 108 to the housing 106. In another example, all or a portion of the first member 108 may be integrally formed with the housing 106. In another example, all or a portion of the first member 108 may be affixed to the housing 106 via an electrically conductive adhesive or via welding. In another example, all or a portion of the first member 108 may be formed integrally with the housing 106.

At least a portion of the first member 108 proximate the housing 106 may be formed using an electrically conductive material, for example an electrically conductive metal or metal alloy. In various embodiments, the first member 108 may be of unitary or single piece construction. In other embodiments, the first member 108 or may include any number of physically connected or coupled portions or segments, for example an electrically conductive first segment 108A and an electrically insulative or non-conducting second segment 108B. The second segment 108B of the first member 108

The first member 108 may be conductive for all or a portion of its length. The conductive part of the first member 108 may be exposed or may be embedded, enclosed, encapsulated, or otherwise partially or completely covered with a non-conductive material (e.g., leather) as long as the conductive element within the structure is electrically connected to the housing 106. Such a covering may improve an esthetic character of the first member 108.

The housing 106 may have a length 114 as measured between the connection point for the first member 108 to the housing 106 and the second member 110 to the housing 106. The electrically conductive first segment 108A of the first member 108 may have a length 116 as measured from the connection point to the housing 106 to the end or extent of the first segment 108A of the first member 108. The sum of the housing length 114 and the first member first segment 108A length may be a defined value, such as a value that optimizes the efficiency of the antennas 112 by forming a ground plane or counterpoise of appropriate size and dimension. In one example, the sum of the housing length 114 and the first member first segment 108A length may approximately equal one-quarter (¼) to one-half (½) of the wavelength of the signal frequency transmitted or received by one or more of the antennas 112. By way of example, the sum of the housing length 114 and the first member first segment 108A, including antenna length, ideally, must have an electrical length to cause the entire antenna system (antenna and ground plane) to resonate at a desired frequency, which would include its harmonics.

The electrically conductive segment of the first member 108 may include one or more electrically conductive materials. In one example, the electrically conductive segment of the first member 108 may be formed using one or more electrically conductive metals or metal alloys. The electrically conductive segment of the first member 108 may have any shape, size, or geometric configuration. For example, the electrically conductive segment of the first member 108 may be coincident with the first segment 108A of the first member 108. In such an instance, the first segment 108A may include a solid, flexible metal link, or flexible metal lattice type watch band or bracelet. In some instances, for example where a rigid first member 108 is used to form a portion of a watch band, the shape or size of the watch band may be in such way that contact with the user's skin is preferentially maintained. In such instances, the bracelet or watch band may have an inside diameter such that the bracelet maintains contact at a limited number of skin contact points or distanced by design to improve the efficiency of the antennas 112.

The electrically non-conductive segment of the first member 108 may include any number or combination of electrically non-conductive or electrically insulative materials. In one example, the electrically non-conductive segment of the first member 108 may be formed using one or more insulators such as leather or cloth. The electrically non-conductive segment of the first member 108 may have any size, shape, or geometric configuration. For example, the electrically non-conductive segment of the first member 108 may be coincident with the second segment 108B of the first member 108.

In some instances, the second member 110 may be physically coupled to the housing 106. For example, the second member 110 may be pivotable or solidly coupled to the housing 106 using a pin or similar attachment device to permanently attach the second member 110 to the housing 106. In some implementations, the one or more antennas 112 extending from the exterior surface of the housing 106 may be placed or positioned internal to or inside of the electrically non-conductive segment of the second member 110. For example, all or a portion of the one or more antennas 112 that extend from the exterior surface of the housing 106 may be partially or completely encapsulated in the electrically non-conductive material used to provide the second member 110 (e.g., inside of a leather portion of a watch band).

The antennas 112 extending from the exterior of the housing 106 may be left exposed to incorporated into (e.g., embedded, encapsulated, or otherwise covered by) the first segment 110A of the second member 110. The antennas 112 couple to the electronic circuit board 104 disposed within the housing 106 and exit from the housing 106 via one or more apertures, passages, or similar conduits. The first segment 110A of the second member 110 may be rigidly coupled to the housing 106 or may be coupled to the housing 106 using a limited or restricted rotation or movement attachment fixture to protect the portion of the antenna 112 exiting the housing 106 from damage due to mechanical fatigue.

In various embodiments, the second member 110 may include a unitary or single piece construction. For example, the second member 110 may include a single, flexible, member fabricated from an electrically non-conductive material such as cloth or leather. In other embodiments, the second member 110 or may include or be apportioned into any number of physically connected or coupled portions or segments. For example an electrically non-conductive or insulative first segment 110A in which the number of antennas 112 may be incorporated, encapsulated, housed, or otherwise positioned and an electrically conducting second segment 110B.

In embodiments, the second segment 108B of the flexible first member 108 may include a conductive portion. In embodiments, the second segment 110B of the flexible second member 110 may include a conductive material. However, when implemented as a flexible watch band or similar appliance in which the second segment 110B of the flexible second member 110 is proximate the one or more antennas 112, the second segment 108B of the flexible first member 108 and the second segment 110B of the flexible second member 110 may not both include a conductive material that couple together when in use.

In implementations such as a rigid bracelet, all or a portion of the housing 106, a rigid first member 108, and a rigid second member 110, may be integrally formed using one or more electrically conductive materials. In such implementations, rather than being placed or positioned inside of a non-electrically conductive segment 110A of the rigid second member 110, some or all of the number of antennas 112 may instead be incorporated, coupled, combined, or otherwise integrally formed with the rigid second member 110 such that all or a portion of the rigid second member 110 forming a portion of the bracelet serves as an antenna 112.

Each of the number of antennas 112 are communicably coupled to at least one receiver, transmitter or transceiver in the electronic device 104. Each of the one or more antennas 112 may have the same or different lengths, transmission properties, structure or geometries. In some implementations, at least one of the one or more antennas 112 may include an antenna coupled to a cellular transceiver operating at a frequency of from about 824 megahertz (MHz) to about 960 MHz or from about 1.71 gigahertz (GHz) to about 2.17 GHz. In some implementations at least one of the one or more antennas 112 may include an antenna coupled to a geolocation (e.g., global positioning system GPS; global navigation satellite system of GLONASS) receiver operating at center frequency of about 1.575 GHz and 1.602 GHz respectively. In some implementations, at least one of the one or more antennas 112 may include an antenna coupled to a BLUETOOTH® or IEEE 802.11 (Wi-Fi) transceiver operating at a frequency of about 2.4 GHz or about 5 GHz.

In at least some implementations, signal interference may occur between two or more of the number of antennas 112. For example, between the high-band (1.71 GHz to 2.17 GHz) cellular antenna and the geolocation antenna (1.575 GHz). In such instances, the electronic device 104 may include an appropriate low-pass matching circuit for a first antenna 112A and high-pass matching circuit for a second antenna 112B to improve the isolation of the two antennas, and consequently improve their efficiency of the antennas.

The wearable electronic device 102 unidirectionally or bidirectionally communicates with one or more remote devices via the network 160. In some instances, the network 160 may include one or more local area networks (LANs), wireless local area networks (WLANs), one or more metropolitan area networks (MANs), one or more cellular networks (e.g., global system for mobile devices or GSM networks, code division multiple access or CDMA networks), or one or more worldwide networks such as the World Wide Web or Internet. In some embodiments, the one or more antennas 112 may be used to unidirectionally or bidirectionally communicably couple with one or more computing devices 120 such as one or more desktop, laptop, notebook, ultraportable, or tablet computers via the network 160. In some embodiments, the one or more antennas 112 may be used to unidirectionally or bidirectionally communicably couple with one or more servers 130 via the network 160. In some embodiments, the one or more antennas 112 may be used to unidirectionally or bidirectionally communicably couple with one or more network storage devices 140 via the network 160. In some embodiments, the one or more antennas 112 may be used to unidirectionally or bidirectionally communicably couple with one or more portable electronic devices 150 such as one or more cellular telephones, smartphones, personal digital assistants, wearable computing devices, or similar via the network 160.

Figure 2A:
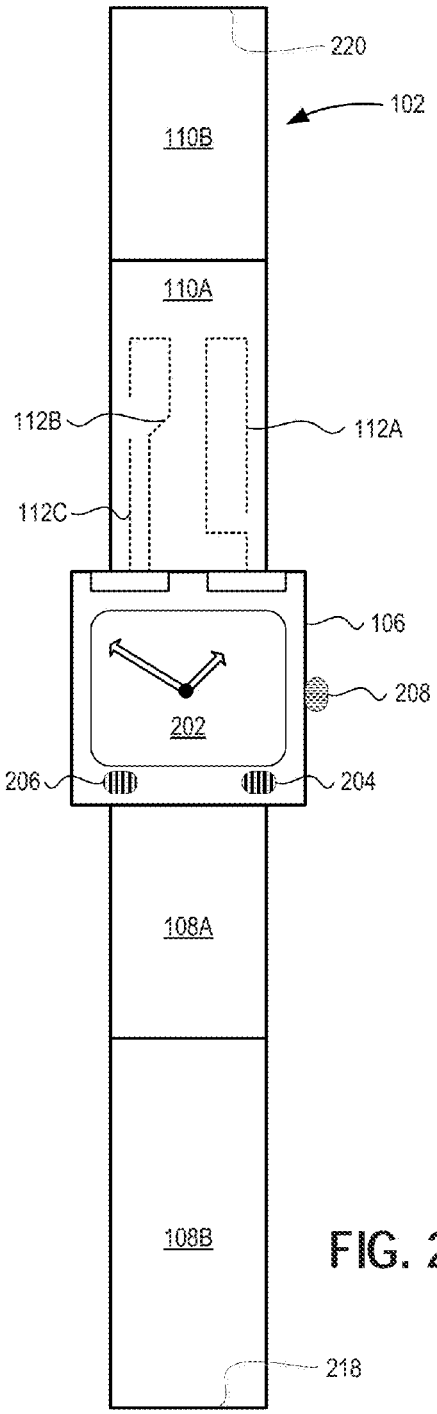
FIG. 2A is a plan view depicting an example wearable electronic device and antenna system in the form of a wristwatch, in accordance with at least one embodiment of the present disclosure.
Figure 2B:
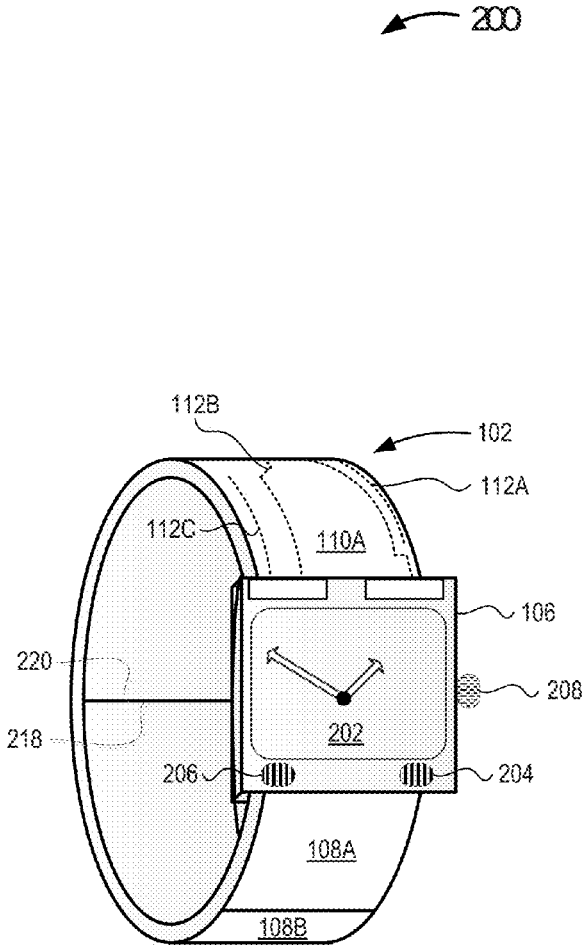
FIG. 2B is a perspective view depicting the example wearable electronic device and antenna system in the form of a wristwatch depicted in FIG. 2A, in accordance with at least one embodiment of the present disclosure

FIG. 2A and FIG. 2B illustrate an example wearable electronic device 102 in the form of a wristwatch 200 having a flexible first member 108 that is physically and electrically conductively coupled to the housing 106 and a flexible second member 110 that is physically coupled to the housing 106, in accordance with at least one embodiment of the present disclosure. In embodiments, the electronic device 104 may include any number of machine-readable instruction sets that cause the electronic device 102 to function variously as a timekeeper/watch and as a communications device. In such embodiments, the electronic device may be communicably coupled to various input/output (I/O) devices such as a display device 202, an audio output device (e.g., speaker) 204, an audio input device (e.g., microphone) 206, and a user input device 208 such as a pushbutton or scroll wheel.

The first segment 108A of the flexible first member 108 includes an electrically conductive structure providing an extended ground plane or antenna counterpoise. In some implementations, the first segment 108A of the flexible first member 108 may be hidden or otherwise partially or completely covered in one or more materials selected based on antenna performance or based at least in part on aesthetics. The first segment 108A of the flexible first member 108 may be embedded in aesthetically appealing or attractive conductive or non-conductive materials. The first segment 110A of the flexible second member 110 includes one or more electrically non-conductive materials in which the number of antennas 112 extending from the surface of the housing 106 are disposed. The antennas 112 incorporated or otherwise disposed in the first segment 110A of the flexible second member 110 are electrically coupled to the first segment 108A of the flexible first member 108.

The flexible first member 108 and the flexible second member 110 may be linked or otherwise joined to form the wristband of the watch 200. As illustrated in FIGS. 2A and 2B, the second end 218 of the flexible first member 108 and the second end 220 of the flexible second member 110 may be joined or otherwise attached such that the watch 200 is retained on the user's arm.

Although the flexible first member 108 and the flexible second member 110 are each divided into two sections (108A, 108B and 110A, 110B) as depicted in FIG. 2A and FIG. 2B, the flexible first member 108 and the flexible second member 110 may be apportioned into an equal or unequal number of portions. Further, each of the portions may have equal or unequal lengths. Regardless of the number of portions or the length of each portion, the first segment 108A of the flexible first member 108 functions as a counterpoise or ground plane for one or more antennas 112. To function as a ground plane for the one or more antennas 112, the first segment 108A of the first flexible member 108 is fabricated from a conductive material. To improve the efficiency of the one or more antennas 112, the first segment 108A of the flexible first member 108 may be of a length at least partially determined by the operating frequency or frequencies of each of the one or more antennas 112.

Similarly, regardless of the number of portions or the length of each portion, at least some of the number of antennas 112 extending from the exterior of the housing 106 are incorporated into the first segment 110A of the flexible second member 110. The first segment 110A of the flexible second member 110 is formed or fabricated using a non-conductive material. The use of a non-conductive material for the first segment 110A of the flexible second member 110 insulates at least some of the number of antennas 112 from the remaining portion of the flexible second member 110 and from the surface of an object placed proximate the flexible second surface (e.g., a user's wrist placed inside the watch band). To improve the efficiency of at least some of the one or more antennas 112, the first segment 110A of the flexible second member 110 may be of a length at least partially determined by the operating frequency or frequencies of each of the one or more antennas 112.

In implementations, the first segment 108A of the flexible first member 108 may be partially or completely covered or even encapsulated in an electrically non-conductive material. In such implementations, the electrically non-conductive material used to cover or encapsulate the first segment 108A of the flexible first member 108 may be the same as or different than an electrically non-conductive material used to fabricate the non-electrically conductive second segment 108B of the flexible first member 108. In some implementations, the second segment 108B of the flexible first member 108 may be fabricated from an electrically conductive material such as one or more electrically conductive metals or one or more electrically conductive, metal alloys.

In implementations, the second segment 110B of the flexible second member 110 may be fabricated in whole or in part using an electrically non-conductive material. In such instances, the electrically non-conductive material used for the second segment 110B of the flexible second member 110 may be the same as or different from the electrically non-conductive material encapsulating the one or more antennas 112 incorporated into the first segment 110A of the flexible second member 110.

The one or more antennas 112 electrically couple to the ground plane formed by the first segment 108A of the flexible first member 108 via the electric circuit board 104 and the housing 106. In embodiments where the flexible first member 108 is apportioned into a first segment 108A and a second segment 108B, and the second member 110 is apportioned into a first segment 110A and a second segment 110B, the antennas 112 remain electrically separated from the ground plane by one or more electrically non-conductive segments in either (or both) the flexible first member 108 (e.g., the second segment 108B of the flexible first member 108) or the flexible second member 110 (e.g., the second segment 110B of the flexible second member 110).

Such electrical isolation of the number of antennas 112 from the ground plane may be accomplished, for example, by ensuring that the second segment 110B of the flexible second member 110 and the second segment 108B of the flexible first member 108 are not both fabricated using an electrically conductive material, particularly when the two segments 110B and 108B connect in close proximity of the antenna structures leaving no sufficient distance to avoid coupling of antennas to the conductive 110B segment. In embodiments, to improve the efficiency and performance of the number of antennas 112 incorporated or otherwise combined into the first segment 110A of the flexible second member 110, at least one electrically non-conductive segment may be disposed between the ground plane formed by the first segment 108A of the flexible first member 108 and the first segment 110A of the flexible second member 110.

FIG. 3A, FIG. 3B, and FIG. 3C illustrate an example wearable electronic device 102 in the form of a bracelet 300 having a rigid first member 108 that is physically and electrically conductively coupled to the housing 106 and a rigid second member 110 that is physically and electrically coupled to the housing 106, in accordance with at least one embodiment of the present disclosure.

Bracelet 300 may include a rigid third member 306 having a first end 310 and a second end 312. In embodiments, the first end 310 of the rigid third member 306 is electrically coupled to the electronic circuit board 104 via a plurality of conductive elements 314, such as a coaxial cable. In embodiments, the first end 310 of the rigid third member 306 may be pivotably coupled to the first member 108 using one or more non-conductive rotatable connectors 302 such as one or more hinges. Such a non-conductive rotatable connector 302 may be used to rotatably couple the first end 310 of the rigid third member 306 to the first member 108 while physically separating and electrically isolating the rigid third member 306 from the first member 108.

In embodiments, the second end 312 of the rigid third member 306 may include one or more latching elements 304 that are used to physically and electrically couple the rigid third member 306 to the rigid second member 110. Thus, when the bracelet 300 is closed, the rigid third member 306 is physically and electrically coupled to the rigid second member 110 via one or more latches 304 and is electrically coupled to the electronic circuit board 104 via the plurality of conductors 308.

The third member 306 provides the antenna 112 for bracelet 300. The plurality of conductors 314 coupled to the electronic circuit board 104 and extending from the housing 106 are physically incorporated, combined, or otherwise integrated into the rigid third member 306 to provide the antenna 112.

In embodiments, the bracelet 300 provides a loop antenna (i.e., when the rigid third segment 306 is connected to the rigid second segment 110) and a dipole antenna (i.e., when the rigid third segment 306 is disconnected from the rigid second segment 110). In one embodiment, the loop antenna created by coupling the rigid third member 306 to the rigid second member 110 may resonate at a base resonant frequency of approximately 1800 MHz and all odd harmonics of the base resonant frequency. In one embodiment, the dipole antenna created by decoupling the rigid third member 306 from the rigid second member 110 may resonate at a base resonant frequency of approximately 750 MHz and all odd harmonics of the base resonant frequency.

In some implementations, the electronic device 104 may include one or more matching circuits useful for impedance matching the loop antenna (i.e., a closed bracelet) and the dipole antenna (i.e., the open bracelet) to the operating frequency of the antenna. In embodiments, the fit of the bracelet 300 about a user's wrist may affect the efficiency of the antenna 112. For example, significant attenuation may occur when the bracelet 300 is tightly fitted to the user's wrist due to the detuning that occurs as a consequence of broad contact with the user's wrist and the energy losses caused by the user's hand. In another example, less attenuation may occur when the bracelet 300 is loosely fitted to the user's wrist such that the contact between the bracelet and the user's wrist is limited to a few (i.e., two) locations.

Figure 4:
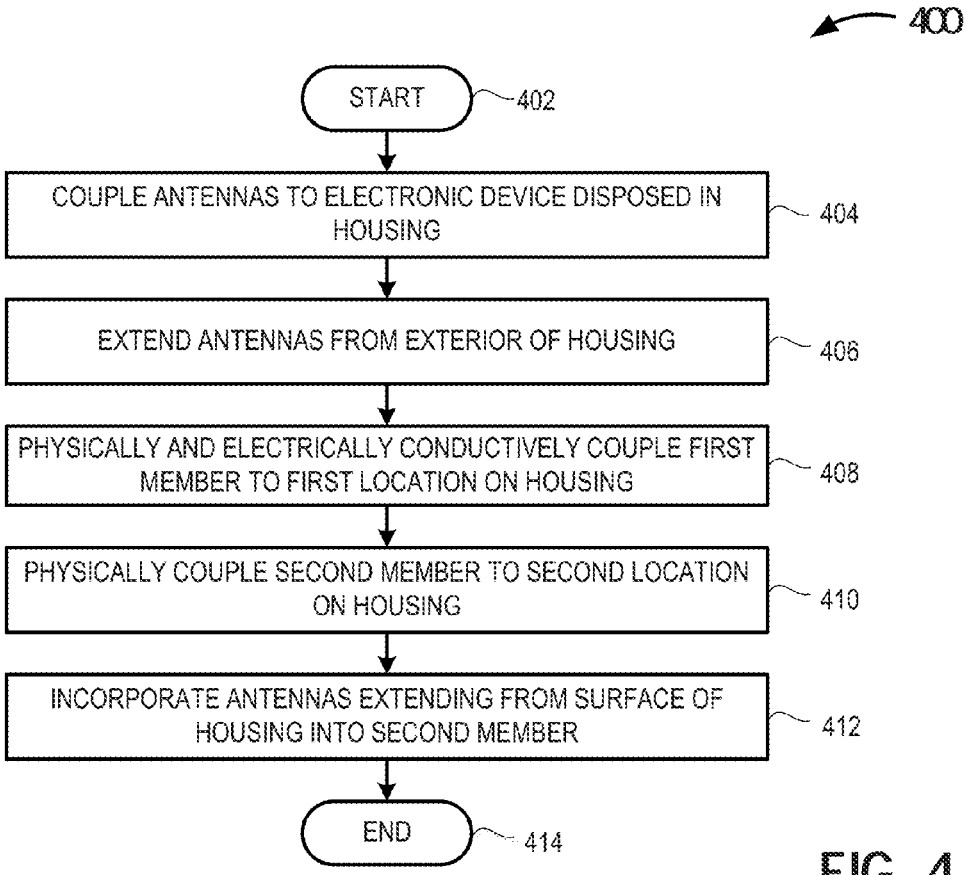
FIG. 4 is a high-level flow diagram of an example method for including a wearable antenna system communicably coupled to a wearable electronic device, in accordance with at least one embodiment of the present disclosure.

FIG. 4 is a high-level flow diagram of an illustrative method 400 of including a wearable antenna system communicably coupled to a wearable electronic device 102, in accordance with at least one embodiment of the present disclosure. The method 400 commences at 402.

At 404, any number of antennas 112 are electrically conductively coupled to an electronic device 104 disposed in a housing 106. Such antennas 112 may include one or more antennas operating in one or more current or future cellular frequency bands. Example cellular frequency bands are 824 MHz to 960 MHz and 1710 MHz to 2170 MHz. Such antennas 112 may include one or more antennas operating in one or more current or future Wi-Fi or BLUETOOTH® operating frequencies. An example Wi-Fi or BLUETOOTH® frequency is 2.4 GHz. Such antennas 112 may include one or more antennas operating in one oClaimsr more current or future global positioning system operating frequencies. An example global positioning system frequency is 1.575 GHz.

At 406, at least some of the number of antennas 112 are extended from the electronic device 104 through one or more exterior surfaces of the housing 106 disposed about at least a portion of the electronic device 104.

At 408, the first member 108 physically and electrically conductively couples to a first location on the housing 106. In some implementations, the first member 108 and the housing 106 may be mechanically and electrically coupled using one or more fixtures or similar attachment devices that provide a pivotable connections between the first member 108 and the housing 106. In one example, the one or more fixtures or attachment devices may include one or more pins or similar devices permitting motion (i.e., rotation) along or about one or more axes. In some implementations, the first member 108 and the housing 106 may be affixed or otherwise permanently or detachably attached to each other in a manner providing a physical and electrical connection. For example, the first member 108 may be formed integral with at least a portion of the housing 106.

At 410, the second member 110 physically couples to a second location on the housing 106. In embodiments, the first location where the first member 108 attached to the housing 106 and the second location where the second member 110 attached to the housing 106 may be separated by a first distance. In some implementations, the first location where the first member 108 attaches to the housing 106 and the second location where the second member 110 attaches to the housing 106 may be on opposing sides of the housing 106 such that the first distance separating the first member 108 and the second member 110 is the length of the housing 106 itself.

In some instances, the conductive first segment 108A of the first member 108 may extend a second distance from the second location where the second member 110 attaches to the housing 106. In such instances, the sum of the antenna 112 length, the length of the housing 106 (i.e., the first distance) and the length of the first segment 108A of the first member 108 (i.e., the second distance) may be approximately equal to the wavelength of the signals transmitted or received by one or more of the number of antennas 112.

At 412, at least some of the number of antennas 112 extending from the exterior of the housing 106 are incorporated into the first segment 110A of the second member 110. In some implementations, the number of antennas 112 may be at least partially encapsulated in an electrically non-conductive material in the first segment 110A of the second member 110. In some implementations, the number of antennas 112 may be formed integral with all or a portion of the first segment 110A of the second member 110. The method 400 terminates at 414.

Figure 5:
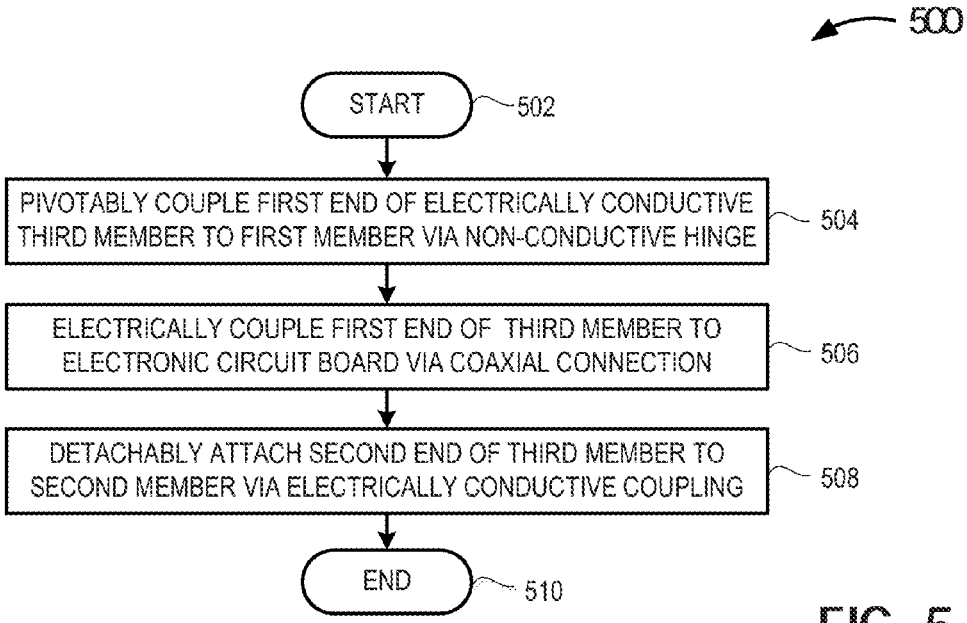
FIG. 5 is a high-level flow diagram of an example method for including a wearable antenna system communicably coupled to a wearable electronic device in the form of a hinged bracelet, in accordance with at least one embodiment of the present disclosure.

FIG. 5 is a high-level flow diagram of an illustrative method 500 of including a wearable antenna system communicably coupled in a wearable electronic device 102 in the form of a hinged bracelet 300, in accordance with at least one embodiment of the present disclosure. In one or more bracelet embodiments, a third rigid member may provide at least a portion of one or more antennas 112 electrically coupling the electronic circuit board 104 to a first end of the rigid third member 306. In such instances, the entire bracelet 300 may function as a loop antenna when closed and as a dipole antenna when opened. In such an embodiment, all or a portion of the first member 108 and all or a portion of the second member 110 may be rigid and formed integral with the housing 106. As depicted in and described in detail above with regard to FIG. 3, a first end 310 of the rigid third member 306 may be pivotably coupled to the first member 108 via one or more nonconductive hinges 302 or similar. The second end 312 of the rigid third member 306 may be detachably physically and electrically coupled to the second member 110. The method 500 commences at 502.

At 504, a first end of the rigid third member 306 pivotably couples to a rigid first member 108 via one or more hinged or pivotable connections. In some implementations, the first end of the rigid third member 306 pivotably couples to the rigid first member 108 via one or more electrically non-conductive pins. In at least some implementations, the first end of the rigid third member 306 may be physically isolated from the rigid first member 108 such that physical contact does not occur between the rigid third member 306 and the rigid first member 108.

At 506, the first end 310 of the rigid third member 306 electrically conductively couples to the electronic circuit board 104 in the housing 106 via the plurality of conductors 312. For example, in at least one implementation, the first end 310 of the rigid third member 306 electrically conductively couples to the electronic circuit board 104 in the housing 106 via a coaxial cable.

At 508, a second end of the rigid third member 306 detachably physically and electrically conductively couples to the rigid second member 110. The physical and electrical conductive coupling or connection of the rigid third member 306 to the rigid second member 110 causes the bracelet 300 to function as a loop antenna. The physical and electrical conductive decoupling or disconnection of the rigid third member 306 to the rigid second member 110 causes the bracelet 300 to function as a dipole antenna. The method 500 concludes at 510.

The following examples pertain to further embodiments. The following examples of the present disclosure may comprise subject material such as a device, a method, at least one machine-readable medium for storing instructions that when executed cause a machine to perform acts based on the method, means for performing acts based on the method and/or a system for binding a trusted input session to a trusted output session to prevent the reuse of encrypted data obtained from prior trusted output sessions.

According to example 1 there is provided a wearable electronic device. The wearable electronic device may include an electronic circuit board disposed at least partially in a housing. The electronic circuit board may be communicably coupled to at least one antenna that extends from a surface of the housing. The wearable electronic device may include a structure adapted to be worn on a limb, the structure including a first member physically and electrically conductively coupled to the housing, and a second member physically coupled to the housing, where the second member incorporates at least a portion of the at least one antenna.

Example 2 may include elements of example 1 and the wearable electronic device may be adapted to be worn on the wrist.

Example 3 may include elements of example 2 where the first member comprises an electrically conductive first segment physically and electrically conductively coupled to the housing.

Example 4 may include the elements of example 3 where the first member further comprises an electrically non-conductive second segment physically coupled to the electrically conductive first segment.

Example 5 may include the elements of example 3 where the second member comprises an electrically non-conductive first segment, the non-conductive first segment physically coupled to the housing and where the second member incorporates at least a portion of the at least one antenna by encapsulating the portion of the at least one antenna that extends into the electrically non-conductive segment.

Example 6 may include the elements of example 5 and may additionally include at least one fastener to physically couple the second segment of the first member to the second member.

Example 7 may include the elements of example 2, where the first member and the second member comprise electrically conductive, rigid, members and the rigid first member and the rigid second member are integrally formed with the housing.

Example 8 may include elements of example 7, and may additionally include an electrically conductive third member having a first end and a second end, the first end pivotably coupled to the first member via a non-electrically conductive hinge, wherein the first end of the third member does not physically contact the first member.

Example 9 may include elements of example 8 and may additionally include a plurality of conductors electrically conductively coupling the electronic circuit board to the first end of the third member.

Example 10 may include elements of example 9 where the plurality of conductors comprises a coaxial cable.

Example 11 may include elements of example 10 and may additionally include at least one detachable latch that physically and electrically conductively couples the second end of the third member to the second member where at least a portion of the third member provides at least a portion of the at least one antenna.

Example 12 may include elements of any of examples 1 through 11 where the housing comprises a metallic material having a first length measured between a first attachment point of the first member to the housing and a second attachment point of the second member to the housing, the first member comprises an electrically conductive segment having a second length measured from the first attachment point to an end point of the electrically conductive segment, and the sum of a length of the at least one antenna, the first length, and the second length equals about a wavelength of an operating frequency of the at least one antenna.

Example 13 may include elements of any of examples 1 through 11 where the at least one antenna includes an antenna operating at a frequency of about 1.575 GHz, a transceiver operating at about 2.4 GHz, or a transceiver operating in a frequency band of either: from about 824 MHz to about 960 MHz and from about 1710 MHz to about 2170 MHz.

Example 14 may include elements of any of examples 1 through 11 where the at least one antenna includes a first antenna operating at a frequency of about 1.575 GHz and a second antenna operating at a frequency band of from about 824 MHz to about 960 MHz or a frequency band of from about 1710 MHz to about 2170 MHz.

Example 15 may include elements of example 14 where the electronic circuit board may further include a low-pass matching circuit communicably coupled to the first antenna and a high-pass matching circuit communicably coupled to the second antenna to improve isolation between the first antenna and the second antenna.

According to example 16, there is provided a method of combining at least one antenna with a wearable electronic device. The method may include electrically conductively coupling the at least one antenna to an electronic circuit board disposed at least partially in a housing and extending the at least one antenna from the electronic circuit board to a location external to the housing. The method may further include physically and electrically conductively coupling a first end of a first member to a first location of the housing. The method may additionally include physically coupling a first end of a second member to a second location of the housing, the second location of the housing separated by a first distance from the first location of the housing and incorporating the at least one antenna into the second member.

Example 17 may include elements of example 16 where incorporating the at least one antenna into the second member may include at least partially encapsulating at least a portion of the at least one antenna in an electrically non-conductive material that forms at least a portion of the first end of the second member.

Example 18 may include the elements of example 16 where physically and electrically conductively coupling a first end of a first member to a first location of the housing comprises integrally forming the first end of an electrically conductive, rigid, first member with at least a portion of the housing and where physically coupling a first end of a second member to a second location of the housing comprises integrally forming the first end of an electrically conductive, rigid, second member with at least a portion of the housing.

Example 19 may include elements of example 18 and may additionally include physically separating and pivotably coupling a first end of an electrically conductive, rigid, third member to a second end of the first member via at least one, electrically non-conductive, hinged connection.

Example 20 may include elements of example 19 and may further include electrically conductively coupling the first end of the rigid third member to the electronic circuit board via a plurality of electrical conductors that extend through and are electrically isolated from at least a portion of the electrically conductive, rigid, first member.

Example 21 may include elements of any of examples 16 through 20 where electrically conductively coupling the at least one antenna to an electronic circuit board disposed at least partially in a housing may include electrically conductively coupling a first antenna and a second antenna to the electronic circuit board disposed at least partially in the housing.

Example 22 may include elements of example 21 and may further include configuring the first antenna to operate at one of: a frequency of about 1.575 GHz, a frequency of about 2.4 GHz, a frequency band of about 824 MHz to about 960 MHz or a frequency band of about 1710 MHz to about 2170 MHz.

Example 23 may include elements example 22, and may further include communicably coupling a low-pass matching circuit to the first antenna configured to operate at a frequency of about 1.575 GHz and communicably coupling a high-pass matching circuit to the second antenna.

Example 24 may include elements of any of example 16 through 20 and may further include configuring the at least one antenna to operate at a frequency band of about 824 MHz to about 960 MHz or at a frequency band of about 1710 MHz to about 2170 MHz.

Example 25 may include elements of any of claims 16 through 20, and may further include configuring the at least one antenna to operate at a frequency of about 2.4 GHz According to example 26, there is provided an antenna system that may include a housing defining an interior space. The antenna system may further include an electronic circuit board disposed at least partially within the interior space, the electronic circuit board including at least one conductively coupled antenna that extends from an exterior surface of the housing. The system may further include a flexible member having a first end and a second end, the flexible member including a number of conductive segments and a number of electrically non-conductive segments, the first end including an electrically conductive segment physically and electrically conductively coupled to a first external attachment point on the housing and the second end including an electrically non-conductive segment physically coupled to a second external attachment point on the housing and. The at least one antenna may extend a respective distance from the exterior of the housing and into the electrically non-conductive material at the second end of the flexible member.

Example 27 may include elements of example 26 where the housing and the flexible member are adapted for fitment about a limb.

Example 28 may include elements of example 26 where the at least one antenna extends into the second end of the flexible member and are at least partially encapsulated by the electrically non-conductive material.

Example 29 may include elements of example 26 where the electrically conductive segment of the first end of the flexible member is encapsulated by an electrically non-conductive material.

According to example 30, there is provided a wearable electronic system. The wearable electronic system may include a means for electrically conductively coupling at least one antenna to an electronic circuit board disposed at least partially in a housing. The wearable electronic system may further include a means for extending each of the number of antennas to a location external to the housing and a means for physically and electrically conductively coupling a first end of a first member to a first location of the housing. The wearable electronic system may further include a means for physically coupling a first end of a second member to a second location of the housing, the second location of the housing separated by a first distance from the first location of the housing. The system may further include a means for incorporating the at least one antenna into the second member.

Example 31 may include elements of example 30 where the means for incorporating the at least one antenna into the second member may include a means for at least partially encapsulating at least a portion of the at least one antenna in an electrically non-conductive material that forms at least a portion of the first end of the second member.

Example 32 may include elements of example 30 where the means for incorporating at least a portion of the at least one antenna may include a means for integrally forming the first end of an electrically conductive, rigid, first member with at least a portion of the housing. Further, the means for physically coupling a first end of a second member to a second location of the housing may include a means for integrally forming the first end of an electrically conductive, rigid, second member with at least a portion of the housing.

Example 33 may include elements of example 32 and may additionally include a means for physically separating and pivotably coupling a first end of an electrically conductive third member to a second end of the first member via at least one, electrically non-conductive, hinged connection, a means for electrically conductively coupling the first end of the electrically conductive third member to the second end of the first member; and a means for detachably attaching a second end of the electrically conductive third member to a second end of the second member via at least one electrically conductive detachable latch.

Example 34 may include elements of example 33 where the means for physically and electrically conductively coupling a first end of a first member to a first location of the housing may include a means for physically separating and pivotably coupling a first end of an electrically conductive, rigid, third member to a second end of the first member via at least one, electrically non-conductive, hinged connection.

Example 35 may include elements example 34 and may additionally include a means for electrically conductively coupling the first end of the rigid third member to the electronic circuit board via a plurality of electrical conductors that extend through and are electrically isolated from at least a portion of the electrically conductive, rigid, first member.

Example 36 may include elements of any of examples 30 through 35 where the means for electrically conductively coupling at least one antenna to an electronic circuit board disposed at least partially in a housing may include a means for electrically conductively coupling a first antenna and electrically conductively coupling a second antenna to the electronic circuit board disposed at least partially in the housing.

Example 37 may include elements of example 36 and may additionally include a means for operating the first antenna at one of: a frequency of about 1.575 GHz, a frequency of about 2.4 GHz, a frequency band of about 824 MHz to about 960 MHz or a frequency band of about 1710 MHz to about 2170 MHz.

Example 38 may include elements example 37 and may additionally include a means for low-pass filtering of a signal received by the first antenna operating at a frequency of about 1.575 GHz and a means for high-pass filtering of a signal received by the second antenna.

Example 39 may include elements of any of examples 30 through 35 and may additionally include a means for configuring the at least one antenna to operate at a frequency band of about 824 MHz to about 960 MHz or at a frequency band of about 1710 MHz to about 2170 MHz.

Example 40 may include elements of any of examples 30 through 35 and may additionally include a means for receiving one or more signals at an operating frequency of about 2.4 MHz communicably coupled to the at least one antenna.

As used in any embodiment herein, the terms "system" or "module" may refer to, for example, software, firmware and/or circuitry configured to perform any of the aforementioned operations. Software may be embodied as a software package, code, instructions, instruction sets and/or data recorded on non-transitory computer readable storage mediums. Firmware may be embodied as code, instructions or instruction sets and/or data that are hard-coded (e.g., non-volatile) in memory devices. "Circuitry", as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry or future computing paradigms including, for example, massive parallelism, analog or quantum computing, hardware embodiments of accelerators such as neural net processors and non-silicon implementations of the above. The modules may, collectively or individually, be embodied as circuitry that forms part of a larger system, for example, an integrated circuit (IC), system on-chip (SoC), desktop computers, laptop computers, tablet computers, servers, smartphones, etc.

Any of the operations described herein may be implemented in a system that includes one or more storage mediums (e.g., non-transitory storage mediums) having stored thereon, individually or in combination, instructions that when executed by one or more processors perform the methods. Here, the processor may include, for example, a server CPU, a mobile device CPU, and/or other programmable circuitry. Also, it is intended that operations described herein may be distributed across a plurality of physical devices, such as processing structures at more than one different physical location. The storage medium may include any type of tangible medium, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), embedded multimedia cards (eMMCs), secure digital input/output (SDIO) cards, magnetic or optical cards, or any type of media suitable for storing electronic instructions. Other embodiments may be implemented as software modules executed by a programmable control device.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed:

1. A wearable electronic device, comprising:

an electronic circuit board at least partially disposed in a housing, the electronic circuit board communicably coupled to at least one antenna that extends from an exterior surface of the housing; and a structure adapted to be worn on a limb, the structure including a first member physically and electrically conductively coupled to the housing, and a second member physically coupled to the housing;

wherein:

the second member incorporates at least a portion of the at least one antenna;

the first member comprises an electrically conductive first segment that is physically and electrically coupled to the housing; and the first member further comprises an electrically non-conductive second segment that is physically coupled to the electrically conductive first segment.

2. The device of claim 1 wherein the wearable electronic device is adapted to be worn on the wrist.

3. The device of claim 1 wherein:

the second member comprises an electrically non-conductive first segment that is physically coupled to the housing; and at least a portion of the at least one antenna is encapsulated in the electrically non-conductive first segment.

4. The device of claim 3, further comprising at least one fastener to physically couple the second segment of the first member to the second member.

5. The device of claim 2 wherein the first member comprises a first electrically conductive rigid member and the second member comprises a second electrically conductive rigid member, wherein the first electrically conductive rigid member and the second electrically conductive rigid member are integrally formed with the housing.

6. The device of claim 5, further comprising an electrically conductive third member having a first end and a second end, the first end pivotably coupled to the first member via a non-electrically conductive hinge, wherein the first end of the third member does not physically contact the first member.

7. The device of claim 6, further comprising a plurality of conductors electrically coupling the electronic circuit board to the first end of the third member.

8. The device of claim 7, wherein the plurality of conductors comprise a coaxial cable.

9. The device of claim 8, further comprising at least one detachable latch that physically and electrically conductively couples the second end of the third member to the second member;

wherein at least a portion of the third member provides at least a portion of the at least one antenna.

10. The device of claim 1 wherein the housing comprises a metallic material having a first length measured between a first attachment point of the first member to the housing and a second attachment point of the second member to the housing;

wherein the electrically conductive first segment has a second length measured from the first attachment point to an end point of the electrically conductive first segment; and wherein the sum of a length of the at least one antenna, the first length, and the second length equals about a wavelength of an operating frequency of the at least one antenna.

11. The device of claim 1 wherein the at least one antenna includes an antenna configured to operate at a frequency of about 1.575 GHz, a frequency of about 2.4 GHz, a frequency band from about 824 MHz to about 960 MHz, or a frequency band from about 1710 MHz to about 2170 MHz.

12. The device of claim 11 wherein the at least one antenna includes a first antenna and a second antenna and the electronic circuit board includes a low-pass matching circuit communicably coupled to the first antenna and a high-pass matching circuit communicably coupled to the second antenna.

13. A method of combining at least one antenna with a wearable electronic device, comprising:

electrically conductively the at least one antenna to an electronic circuit board disposed at least partially in a housing;

extending the at least one antenna from the electronic circuit board to a location external to the housing;

physically and electrically conductively coupling a first end of a first member to a first location of the housing;

physically coupling a first end of a second member to a second location of the housing, the second location of the housing separated by a first distance from the first location of the housing; and incorporating the at least one antenna into the second member;

wherein incorporating the at least one antenna into the second member comprises at least partially encapsulating at least a portion of the at least one antenna in an electrically non-conductive material that forms at least a portion of the first end of the second member.

14. The method of claim 13 wherein physically and electrically conductively coupling a first end of a first member to a first location of the housing comprises integrally forming the first end of an electrically conductive, rigid, first member with at least a portion of the housing; and wherein physically coupling a first end of a second member to a second location of the housing comprises integrally forming the first end of an electrically conductive, rigid, second member with at least a portion of the housing.

15. The method of claim 14, further comprising:

physically separating and pivotably coupling a first end of an electrically conductive, rigid, third member to a second end of the first member via at least one, electrically non-conductive, hinged connection.

16. The method of claim 15, further comprising:

electrically conductively coupling the first end of the rigid third member to the electronic circuit board via a plurality of electrical conductors that extend through and are electrically isolated from at least a portion of the electrically conductive, rigid, first member.

17. The method of claim 13 wherein electrically conductively coupling the at least one antenna to an electronic circuit board disposed at least partially in a housing comprises:

electrically conductively coupling a first antenna and electrically conductively coupling a second antenna to the electronic circuit board disposed at least partially in the housing.

18. The method of claim 17, further comprising:

configuring the first antenna to operate at one of: a frequency of about 1.575 GHz, a frequency of about 2.4

GHz, a frequency band of about 824 MHz to about 960 MHz or a frequency band of about 1710 MHz to about 2170 MHz.

19. The method of claim 18, further comprising:

communicably coupling a low-pass matching circuit to the first antenna configured to operate at a frequency of about 1.575 GHz; and communicably coupling a high-pass matching circuit to the second antenna.

20. A wearable electronic system, comprising:

a means for electrically conductively coupling at least one antenna to an electronic circuit board disposed at least partially in a housing;

a means for extending the at least one antenna from the electronic circuit board to a location external to the housing;

a means for physically and electrically conductively coupling a first end of a first member to a first location of the housing;

a means for physically coupling a first end of a second member to a second location of the housing, the second location of the housing separated by a first distance from the first location of the housing; and a means for incorporating the at least one antenna into the second member;

wherein the means for incorporating the at least one antenna into the second member comprises a means for at least partially encapsulating at least a portion of the at least one antenna in an electrically non-conductive material that forms at least a portion of the first end of the second member.

* * * * *